US005529485A

United States Patent [19]

D'Ambro et al.

[11] Patent Number: 5,529,485

[45] Date of Patent: Jun. 25, 1996

[54] UNIQUE WICK AND REUSABLE BURNER DEVICE

[76] Inventors: Dominic D'Ambro, 2 Lee Blvd., Malvern, Pa. 19355; Vincent J. DeSantis, 412 Marathon Ct., Naples, Fla. 33962

[21] Appl. No.: 379,355

[22] Filed: Jan. 6, 1995

[51] Int. Cl.[6] ..... F23D 3/18

[52] U.S. Cl. ..... 431/321; 431/320; 431/325; 431/298

[58] Field of Search ..... 431/320, 325, 431/321, 298

[56] References Cited

U.S. PATENT DOCUMENTS 1,954,855 4/1934 Weaver ..... 431/325

4,725,225 2/1988 Gravitt ..... 431/320

5,307,799 5/1994 Scarnato et al. ..... 431/320

*Primary Examiner*—Carroll B. Dority

*Attorney, Agent, or Firm*—Z. T. Wobensmith, III

[57] ABSTRACT

A reusable burner device which provides a flame for warming or cooking food or liquids, which includes a canister carrying fuel such as diethyleneglycol (D.E.G.) or mineral spirits, with a burner assembly therein, which includes an unique wick structure which extends down into the fuel, which includes a plurality of parallel, co-planer strands containing a plurality of threads in side by side arrangement with a thermal conducting wire woven thereabout, which wick is set at a predetermined height to provide a hot flame with a fixed burn time. The device is provided with a cap to close off the burner assembly.

10 Claims, 2 Drawing Sheets

UNIQUE WICK AND REUSABLE BURNER DEVICE

BACKGROUND OF THE INVENTION

1. Field of the Invention

This invention relates to a unique wick used with a reusable burner device of the liquid fuel type which wick is a composite constructed of parallel strands of fiberglass, which are held together by thermal conducting wire to provide a wick of predetermined width and height which realizes consistent fuel combustion.

2. Description of the Prior Art

Burner devices which provide heat to warm or cook food or liquids such as in a chafing dish are known in the art. Most prior art devices are commonly of the "canned heat" type. The two most widely used types of fuels for such devices are solid or liquid. The solid fuel is a flammable semi-solid (impregnated chemical gel and/or liquid saturated inert substrate); and the liquid, a refined, specific use, flammable type. The flames produced by burners using these fuels are:

First, a flame above and on the surface of the exposed fuel of an open fuel reservoir, the height determined by the surface of the remaining fuel and the open reservoir being the burner assembly (solid type such as alcohol gel);

Second, a flame on and above a surface of fixed area, the height constituted by a hole in the top or lid of the reservoir exposing a non-consumable substrate totally saturated and butted tightly against the underside of the top or lid which functions as the burner assembly (solid type such as impregnated chemical gel and/or liquid saturated inert substrate); and Third, a flame on and above a saturated surface of fixed area and height on a non-consumable wick totally saturated, protruding through, and snugly retained by, an aperture in a portion of a reservoir cover or seal, which is the burner assembly (liquid fuel).

A major requirement in the design and manufacture of these devices is that they maintain a consistent heat output at the surface of the cooking or warming vessel for a specified amount of time. In general, devices, which use either type of fuel, produce a flame with characteristics dependent on the fuel vaporization surface, fuel supply at the surface, and introduction of oxygen via normal aspiration induced by the flame. The heating value of the flame and the time that it will burn is a result of fuel feed control, the characteristics of the fuel, and the flame size, all of which are determined by research and testing and whose fidelity is protected and controlled during manufacture of the device. The end result of this effort, and heretofore desired, is a very consistent product having a fixed heat rate (BTU/hour) and consequently a fixed burn time. The first solid fuel device does not particularly lend itself to consistent heating of vessels, because the origin of the flame changes position vertically as does the flame's steadiness, and its quality diminishes as it burns deeper down into the reservoir.

The second solid fuel type burner is an improvement over the first; however, the liquid fuel device is more desirable, due to its flame consistency, high heat, safety, and is reusable.

A well known type of solid product is "Sterno", which includes a metal can with a removable top with exposed alcohol gel that is lit to provide a flame. While this product will heat food and liquids it is hazardous, with a low flash point of 55 degrees Fahrenheit and therefor must be treated with great care. The "Sterno" product also gives off odor as it burns, the wick decomposes, the fuel evaporates and is not reusable, the container heats up and can set a fire if tipped over. The flame height and intensity will also vary as the fuel is consumed. Similar disadvantages are found in the second form of solid fuel burning devices.

Examples of devices which provide flame, and are used for illumination, or to produce heat are disclosed in the U.S. Patents to Giangiulio U.S. Pat. Nos. 3,885,905 and 4,025,290; Giangiulio et al. U.S. Pat. No. 4,464,109 and Menter et al. U.S. Pat. No. 4,611,986. However, none of these devices provides all the desired characteristics.

The device of the invention provides a consistent high heat flame, of preset height during its operating life, is non-hazardous to transport and use, is reusable, is odorless, whose fuel does not evaporate, the products of combustion are non-toxic, and which device in addition enjoys other advantages.

SUMMARY OF THE INVENTION

An improved refractory wick structure has now been found and developed which is used in burner devices and transports combustible fuel from a fuel reservoir to the flame holding area by means of a capillary mechanism. This structure is reusable for a multiplicity of time increments, and embodies a structurally improved refractory wick of parallel strands of fiberglass yarn retained together by thermal conducting wire, that maintains predetermined dimensions of height and width throughout its life. Constant wick dimensions are assured and, therefore, a constant flame height is provided, while at the same time a high efficiency rate control of fuel flow is achieved. The combustion rate during a single burn time or during a multiplicity of combination use modes of the burner is constant.

The principal object of the invention is to provide an improved wick structure for use in a reusable burner device that overcomes the disadvantages of the prior art and provides many positive advantages.

A further object of the invention is to provide a burner device that is non-hazardous to transport and use.

A further object of the invention is to provide a burner device wherein the wick structure maintains a constant flame height throughout its useful life.

A further object of the invention is to provide a burner device that is suitable for illumination.

A further object of the invention is to provide a burner device that is odorless and whose fuel does not evaporate.

A further object of the invention is to provide a burner device that produces a large flame for faster and longer heating.

A further object of the invention is to provide an improved wick structure for a burner device with shorter strand length for the total length of the wick, decreasing the resistance to the capillary flow of fuel and increasing the rate and efficiency.

A further object of the invention is to provide a burner device wherein the wick carries a portion of the heat down into the fuel to decrease the viscosity of the fuel and improve the capillary efficiency of the fuel flow to the burn zone.

A further object of the invention is to provide a burner device that can be resealed and reused.

A further object of the invention is to provide a burner device with an improved wick structure that is simple to construct and easy to use, and which does not decompose during use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structure disclosed without departing from the spirit of the invention.

Like numbers refer to like parts throughout the several views.

DESCRIPTION OF THE PREFERRED EMBODIMENT

Figure 1:
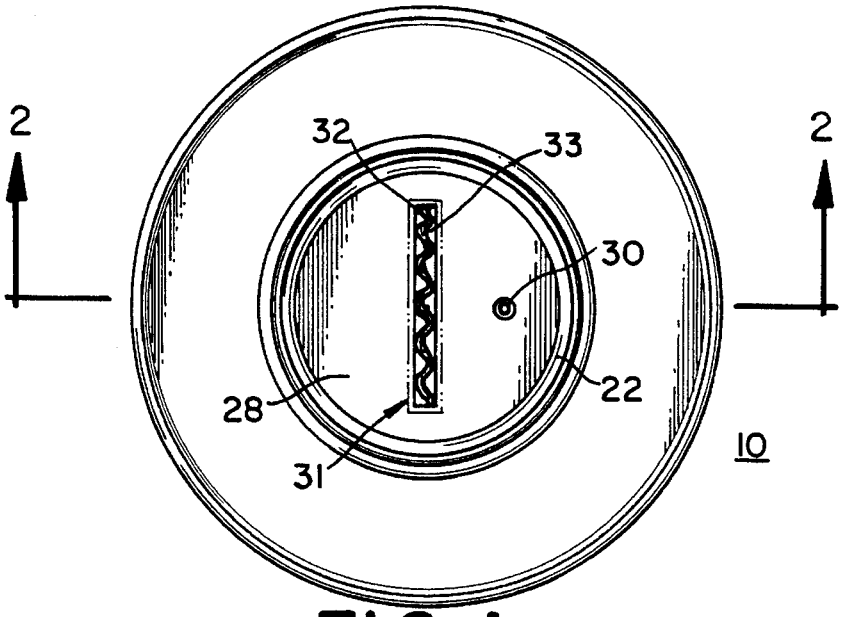
FIG. 1 is a top elevational view of the improved wick structure carried in a burner device.
Figure 2:
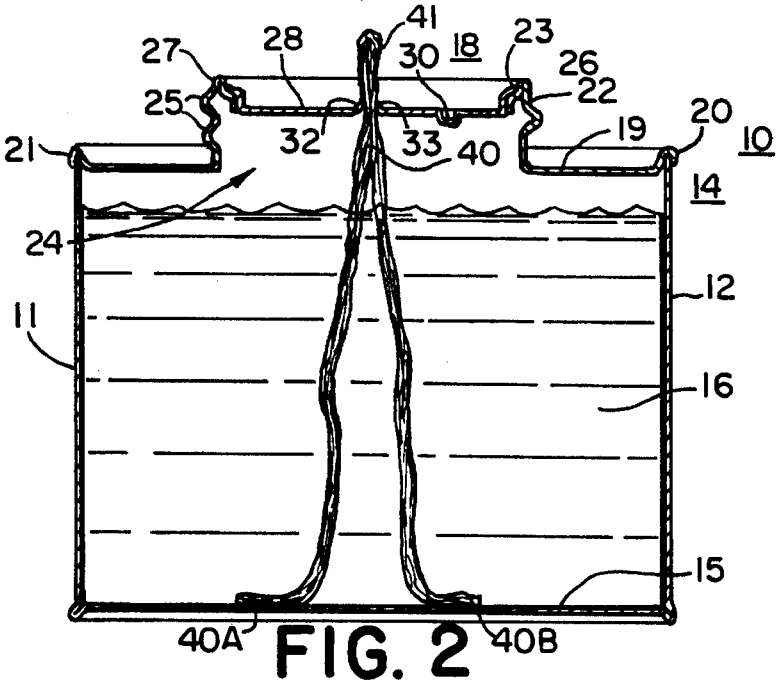
FIG. 2 is a vertical sectional view taken approximately on the line 2—2 of FIG. 1.

Referring now to the drawings and more particularly FIGS. 1 and 2 thereof the burner device 10 incorporating the wick 40 of the invention is therein illustrated. The device 10 includes a reservoir 11 which is of cylindrical configuration with a side wall 12, open at one end 14, and with a bottom wall 15. The reservoir 11 can be formed of any suitable lightweight material, with steel or aluminum being particularly suitable, and which is compatible with the fuel 16 contained therein.

The fuel 16 can be of any suitable type such as mineral spirits, with the preferred fuel being diethyleneglycol (D.E.G.).

The reservoir 11 is closed off by a burner assembly 18, which is of circular configuration, with top wall 19 and an outer rim 20, which is crimped over the top edge 21 of reservoir 11 to seal the assembly thereto in fluid tight relation, and which can be constructed as shown in U.S. Pat. No. 4,464,109.

The top wall 19 has a hollow circular projection 22 extending therefrom, open at lower end 24 and upper end 23, which has outer screw threads 25, which can be engaged by a cap (not shown) to close off the upper end 23.

The projection 22 has a wick holder plate 28. The wick holder plate 28 is of metal construction, and includes a vent hole 30 therein to relieve pressure from the fuel 16 in reservoir 11, but does not permit any appreciable amount of fuel to flow thereout. The vent hole 30 is downwardly concave as viewed from FIGS. 1 and 2, and also serves to permit any fuel which might condense on plate 28 to flow back into reservoir 11. The plate 28 has a transverse slit or opening 31 with rows of teeth 32 and 33 therein extending towards each other. The rows of teeth 32 and 33 are complemental in configuration and extend above the plate 28. A wick 40 is frictionally engaged with the rows of teeth 32 and 33, and can be pulled up and out of the reservoir 11, but can not be pushed down.

The wick 40 is of rectangular shape and folded back on itself prior to being pulled up between the rows of teeth 32 and 33 to a predetermined height above plate 29, which exposes a wick tip 41 for flame production. The wick 40 is preferably in direct contact with the bottom wall 15 of reservoir 11, and each leg 40A and 40B extends at least ¼-inch out over the wall 15.

Figure 3:
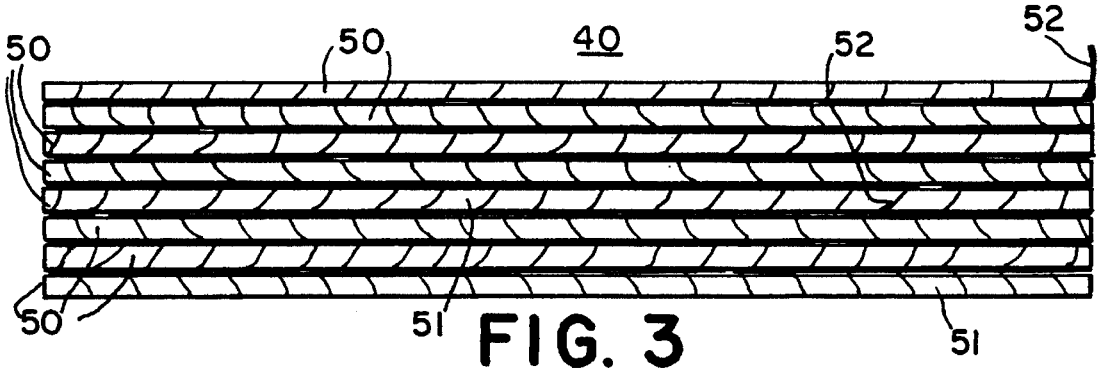
FIG. 3 is a top elevational view, enlarged, of the wick of the invention.

The wick 40 is illustrated in FIG. 3 in its unfolded condition and comprised of a plurality of separated, parallel, longitudinally extending rope-like strands 50, eight being illustrated. The strands 50 are formed of threads 51, and preferably fiberglass with lengths of wire 52 woven thereabout and which extend transversely across the strands 50.

The wire lengths 52 are of metal, which has high heat conductivity, and preferably copper, which is compatible with the heat generated by fuel combustion, and which carries heat from combustion down into the fuel 16 to improve its viscosity and its flow up into wick 40 for combustion.

The wick utilizes a high thermal conducting wire that holds the parallel strands of fiberglass in the required coplaner configuration, but also controls the thermal heat flow into the fuel. The resultant structure permits oxygen to get to the flame, and achieve virtually complete combustion of the fuel without wick decomposition.

The metal wire conducts heat generated by the flame down into the fuel. This action has the effect of decreasing the viscosity of the fuel which in turn increases the capillary efficiency of the fuel flow. It should be understood that as fuel is consumed, the level of the fuel in the reservoir drops and, therefore, the fuel becomes less of a heat sink. The portion of the wick that is not immersed in the fuel increases in temperature. This increase in temperature offsets the gradual increase in the gravitational pull that the fuel encounters in its capillary flow up the wick to the flame holding zone as the fuel recedes from the flame. It is the balance of these various design characteristics that insures constant flame height when the burner is reused at various selected time increments.

It should be further understood that while copper wire of a wide range of dimensions is the preferred material, other wire materials of various diameters can be used to control the design thermal conductivity of the wick. Additionally, wire ductilities can be utilized to provide precise wick structural design and dimensions.

Figure 4:
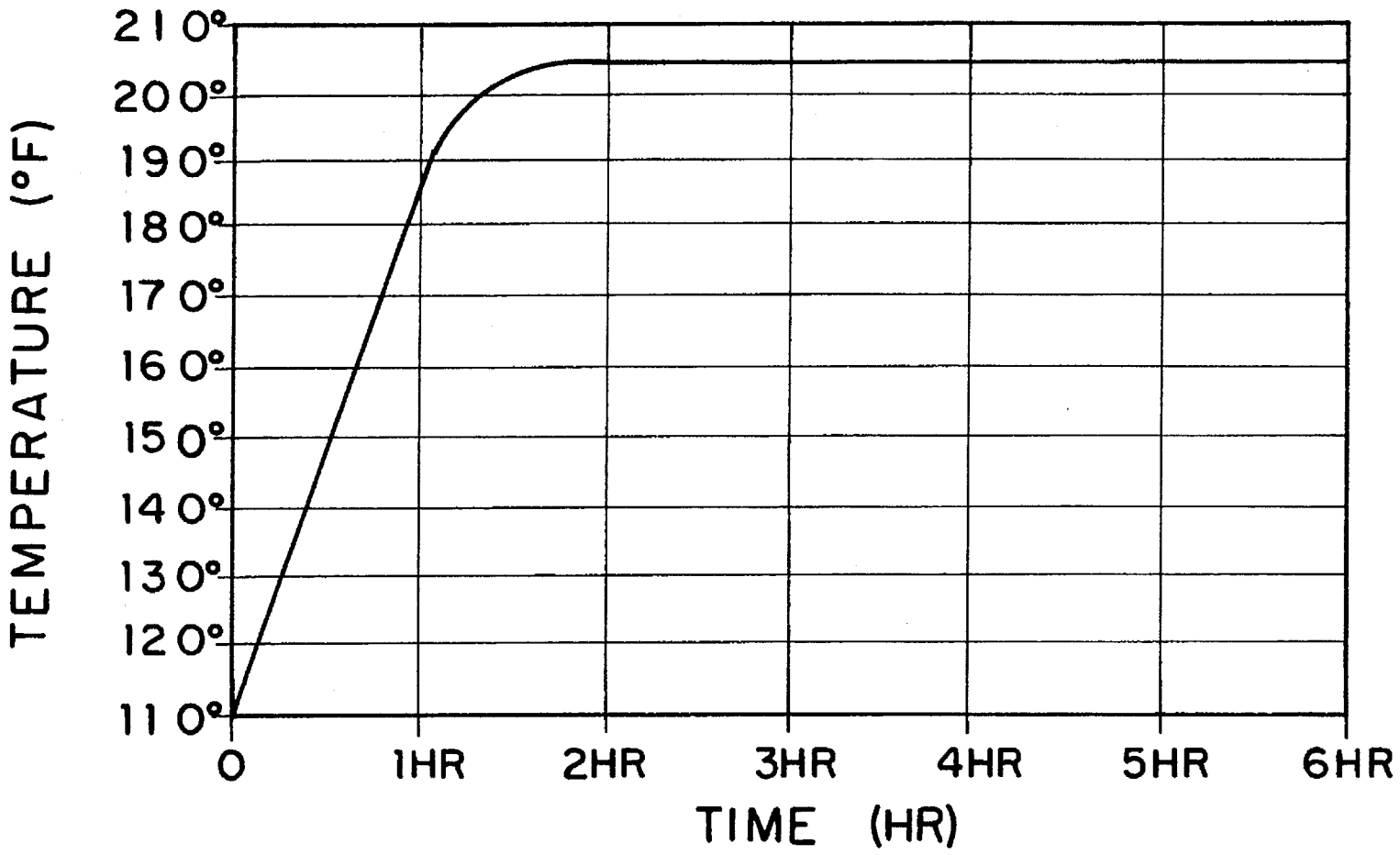
FIG. 4 is a graph illustrating the performance characteristics of a device constructed in accordance with the invention.

Referring now to FIG. 4 which illustrates the performance characteristics of the device. The test device contained 9 ounces of diethyleneglycol (D.E.G.). The device was lit and the temperature profile was calculated over the obtained six hour burn time. The test results indicated that the highest temperature obtained peaked at 205° F. at approximately 1¾ hours, and remained constant throughout the total six hour burn time.

The mode of operation will now be pointed out.

When use of the burner device 10 is desired, the cap (not shown) is removed from the projection 22 to expose the wick tip 41. The wick tip 41 is lit and fuel 16 from canister 11 burns to warm or heat chafing dishes (not shown) or other utensils. If a larger flame is desired, the wick 40 can be pulled up and out between rows of teeth 32 and 33.

The wire lengths 52 carry heat down into the fuel 16, to improve fuel flow, and help to retain the strands 50 together.

If it is desired to extinguish the device, the cap (not shown) is turned onto projection 22 closing it off and extinguishing the flame on wick tip 41, or if desired the flame can be blown out.

The device is now sealed and ready for reuse.

A glass chimney (not shown) may also be placed on the device so that it may be used for illumination.

It is thus apparent that a burner device has been provided with which the objects of the invention are achieved.

I claim:

1. In a reusable burner device for burning liquid fuel which includes a hollow, cylindrical reservoir open at one end with a bottom wall to close off the reservoir, and which contains liquid fuel for burning, a burner assembly attached to said reservoir in fluid tight relation, and closing off the open end of the reservoir, said burner assembly includes a top wall, with a hollow projection extending therefrom and which is open at both its upper and its lower ends, a wick holder plate engaged with said projection closing off said upper end opening, said wick holder plate has a transverse slit therein, at least one row of teeth extending across said slit, the improvement which comprises:

wick means carried by said plate extending through said slit engaged by said teeth, with a tip at a predetermined height above said plate and extending down into said fuel, said wick means includes a wick having a plurality of parallel, co-planar strands containing a plurality of threads in side by side arrangement, and at least one length of thermal conducting wire woven about said strands to retain them together in co-planar configuration, and which extends down into said fuel to carry heat down into said fuel.

2. A burner device as defined in claim 1 in which said reservoir is formed of a lightweight metallic material compatible with said liquid fuel.

3. A burner device as defined in claim 1 in which removable cap means are provided to close off said upper end of said projection.

4. A burner device as defined in claim 1 in which said wick holder plate has vent means to provide for pressure differences and to permit fuel to flow back into said reservoir.

5. A burner device as defined in claim 1 in which said slit is provided with two rows of complemental teeth which extend toward the middle of said slit to engage said wick means.

6. A burner device as defined in claim 1 in which said co-planar strands are of fiberglass threads, and said lengths of wire are of copper.

7. A burner device as defined in claim 3 in which said cap means includes a plurality of external threads on said hollow projection, and a cap to engage said threads to close off said projection above said wick holder plate.

8. A burner device as defined in claim 1 in which said wick is folded back on itself prior to passing through said slit.

9. A burner device as defined in claim 1 in which said wick means has at least a portion thereof in contact with said bottom wall.

10. A burner device as defined in claim 1 in which said threads when heated neutralize changes in the gravitational pull as the fuel level drops in the reservoir.

* * * * *